United States Patent [19]

Becker et al.

[11] 4,148,138

[45] Apr. 10, 1979

[54] CONNECTOR ASSEMBLY TOOL

[75] Inventors: Edward W. Becker, Winder; Thomas A. E. Bender, Marietta; Peter F. Mahr, Roswell; Edwyn H. Petree, Dunwoody, all of Ga.

[73] Assignees: Western Electric Company, Incorporated, New York, N.Y.; Bell Telephone Laboratories, Incorporated, Murray Hill, N.J.

[21] Appl. No.: 873,988

[22] Filed: Jan. 31, 1978

[51] Int. Cl.[2] ..... H01R 43/04

[52] U.S. Cl. ..... 29/749; 29/566.3; 29/753

[58] Field of Search ..... 29/749, 751, 753, 566.3, 29/566.4

[56] References Cited

U.S. PATENT DOCUMENTS

| | | | |
|---|---|---|---|
| 3,845,535 | 11/1974 | Over | 29/749 X |
| 3,858,158 | 12/1974 | Henn et al. | 339/99 R |
| 3,972,101 | 8/1976 | Casey et al. | 29/749 |

*Primary Examiner*—Carl E. Hall

*Attorney, Agent, or Firm*—E. W. Somers

[57] ABSTRACT

A hand-operated tool (50) for assembling stackable elements (52, 53 and 54) of a multicontact electrical connector (51) and for assembling conductors (56 and 57) to the connector includes a head (125) which is automatically positioned for effectively applying forces to the connector at each step of its assembly and to the conductors. An installer causes the head to be moved downwardly through a first incremental distance toward a support (109) into engagement with an element or conductors which are to be moved into secured engagement with an element held on the support. The movement of the head through the first incremental distance and the initiation of its movement through a second incremental distance causes the head to be spaced from the support a predetermined distance which is automatically determined as a function of the number of elements held on the support in that step of the assembly. When the head is moved through the second incremental distance, forces are applied which are sufficient to assemble the conductors and the elements. A return of the head to an unoperated position allows the installer to position another element or conductors for a next sequence of steps in the assembly of the connector.

13 Claims, 25 Drawing Figures

CONNECTOR ASSEMBLY TOOL

TECHNICAL FIELD

This invention relates to a connector assembly tool, and more particularly, to a hand-operated tool which may be used in field and factory environments to assemble elements of a connector and to assemble insulated conductors to elements of the connector.

BACKGROUND ART

A number of different connecting devices are presently used in the communications industry to splice together conductors of cables. In some instances, these connectors may take the form of a simple device for connecting one conductor to another conductor. See for example, U.S. Pat. No. 4,019,250 issued Apr. 26, 1977 in the names of H. C. Bassett et al.

As the number of conductors to be spliced together in any one application increases, the industry has resorted to multiple contact, connectors such as that shown for example in U.S. Pat. No. 3,858,158, which issued Dec. 31, 1974 in the names of Henn et al. It has been estimated that over one billion pair splices are made each year by the telephone industry and a majority of these are made with multiple contact connectors.

The multiple contact connector disclosed in U.S. Pat. No. 3,858,158 is commonly referred to as a stackable connector and includes an index strip and a connector module. The connector module includes a plurality of metallic contact elements each having oppositely disposed conductor-receiving slots. In use, an installer positions an index strip in an assembly tool and insulated conductors from a first group transversely of the index strip in a plurality of conductor-receiving grooves. The conductors are seated in the grooves after which a connector module is positioned above the index strip and secured thereto which causes the conductors to be moved into conductor-receiving slots of the contact elements which extend below the module. Conductors of a second group which are to be spliced to those of the first group are inserted into conductor-receiving grooves of the connector module and the tool is operated to seat those conductors in upper conductor-receiving slots of the contact elements.

It should be apparent that tools which are used to assemble multiple contact, stackable connectors must be capable of imparting sufficient forces to elements of the connector to secure them together. Further, such tools must have the capability of seating conductors within plastic and metallic portions of the connector and of severing excess lengths of the conductors. An uncomplicated tool should include a means which may be actuated in consecutive steps to impart forces while compensating for their application at varying heights of the stackable assembly so that excessive forces are not applied with resulting damage to the connector.

A tool for assembling multiple contact connectors and conductors of cables such as for example, that disclosed in previously mentioned U.S. Pat. No. 3,858,158, is available commercially, but is built to be operated by compressed air or hydraulic systems. However, since a power-operated tool requires excessive support equipment and is cumbersome, its use in manholes and on telephone poles is awkward.

A hand-operated tool for assembling multiple contact stackable connectors is shown, for example, in U.S. Pat. No. 3,972,101. In the patented tool, a support for elements of a connector is selectively positioned with respect to arrays of spaced teeth for holding insulated conductors positioned relative to the elements which are secured together. A conductor-insertion head is then mounted on the tool and is operated to seat the conductors in the connector elements held in the support. The selective positioning of the support at different stages in the assembly of the stackable connector is installer-controlled and the tool head must be mounted on and dismounted from the tool several times during a splicing operation.

It would appear that the prior art does not include a hand-operated tool for assembling stackable connector elements and conductors wherein the tool is automatically positioned for the effective application of assembling forces notwithstanding varying increments of height at which it must be operated. Such a tool would overcome the possibility of an installer-controlled, selective height device being mispositioned which could cause excessive forces to be applied and result in a cracked connector element.

DISCLOSURE OF THE INVENTION

The foregoing problems of prior art stackable connector assembly tools are overcome by a tool which is constructed in accordance with this invention and which automatically and simply compensates between successive movements of a tool head for changes in height of the stackable connector.

A tool for assembling stackable elements to form a connector and for assembling conductors to the elements comprises a support for holding the connector during its assembly in which adjacently positioned elements are secured together to form a stack of elements and conductors are assembled to elements, and facilities for applying forces to each successively stacked element positioned in the support to secure it to an adjacent element previously positioned in the support and for applying forces to conductors to assemble the conductors to the elements. The force-applying facilities are mounted for reciprocal movement which includes movement in one direction through first and then second incremental distances. The tool is operated subsequent to the positioning of each successively stacked element and to the positioning of conductors in an element which is held in the support to move the facilities for applying forces through the first incremental distance to engage the successively stacked elements and the conductors and for then moving said force-applying facilities through the second incremental distance to secure adjacent elements together and to secure conductors to an element. A portion of the tool is responsive to the movement of the force-applying facilities through the first incremental distance and to the initiation of its movement through the second incremental distance for spacing said force-applying facilities a predetermined distance from the support. The portion of the tool is capable of compensating for the number of elements which are held in the support to cause the movement of said force-applying facilities through the second incremental distance to be effective to secure together adjacent elements and to secure conductors to an element.

In order to assemble elements of a connector, which includes an index strip and a connector module, and for assembling conductors to the elements, an installer uses a tool which comprises a support for holding the connector during a sequence of steps of its assembly in which a first group of conductors is assembled to the index strip, a connector module is assembled to the index strip and connected to the first group of conductors, and a second group of conductors is connected to the connector module. The tool comprises a head for applying forces to the connector module to assemble the connector module to the index strip and for assembling the one group of conductors to the index strip and the second group of conductors to the connector module, and facilities for mounting the head to allow movement of the head in a first direction through first and second incremental distances toward the support and in an opposite direction away from the support. The head is moved through the first incremental distance to engage a connector module which is positioned above and in engagement with the index strip, or to engage the first group of conductors which is positioned in the index strip, or to engage the second group of conductors which is positioned in the connector module. Then the head is moved through the second incremental distance toward the support to secure the connector module to the index strip or to secure the first group of conductors to the index strip or the second group to the connector module, and then in an opposite direction away from the support. The tool also includes facilities which are responsive to the movement of the head through the first incremental and to the initiation of movement through the second incremental distances to space the head a predetermined distance from the support to cause its movement through the second incremental distance to be effective to assemble elements of the connector or conductors to the elements.

BRIEF DESCRIPTION OF THE DRAWINGS

Other features of the present invention will be more readily understood from the following detailed description of specific embodiments thereof when read in conjunction with the accompanying drawings, in which.

DETAILED DESCRIPTION

Figure 2:
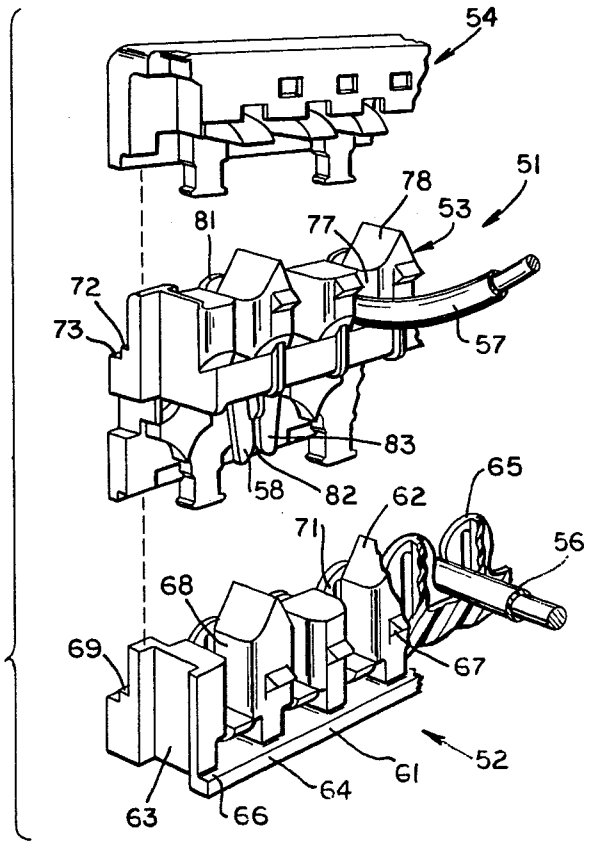
FIG. 2 is an exploded view of elements of a stackable multi-contact connector for connecting together insulated conductors and which is assembled with the tool shown in FIG. 1.
Figure 1:
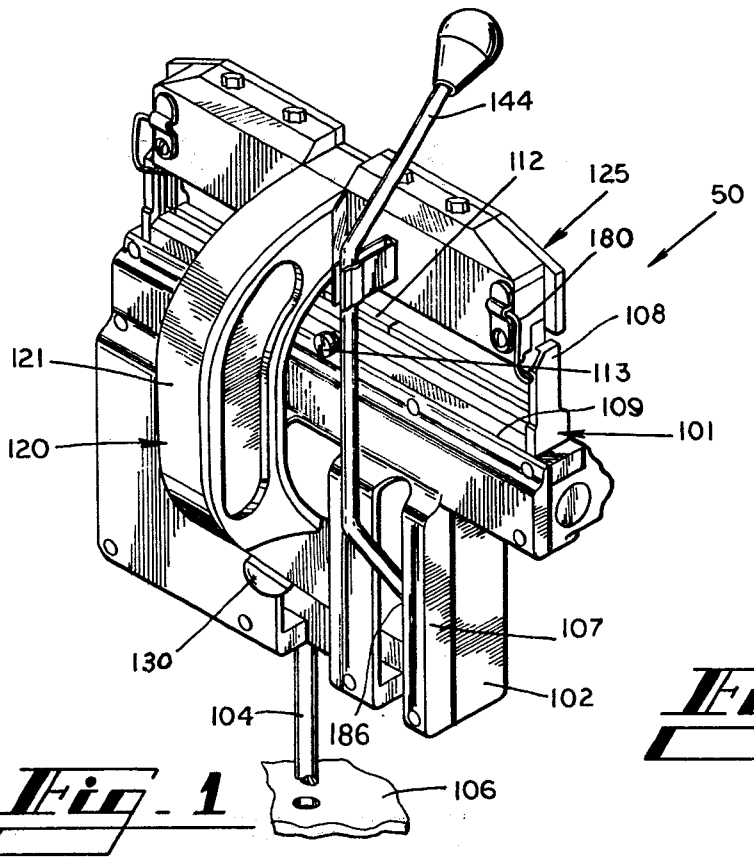
FIG. 1 is an isometric view of a hand-operated tool made in accordance with this invention for assembling a stackable, multi-contact connector.

Referring now to FIG. 1, there is shown, a tool, designated generally by numeral 50, for assembling an electrical connector which is shown in FIG. 2 and which is designated generally by the numeral 51. The electrical connector 51, which is disclosed and claimed in previously mentioned U.S. Pat. No. 3,858,158, includes an index strip, designated generally by the numeral 52, a connector module, designated generally by the numeral 53, and a cap, designated generally by the numeral 54.

The connector 51 includes a plurality of slotted double-ended contact elements 58—58 for connecting together electrically at least one or more conductors 56—56 of a first group of conductors to associated conductors 57—57 of a second group. One end of each of the contact elements 58—58 is received in the index strip 52 when the connector module 53 is mounted thereon to electrically engage an associated conductor 56 held in the index strip. The other end of each of the contact elements 58—58 slices through the insulation of an aligned one of the conductors 57—57 when these conductors are seated in the connector module 53.

As can best be seen in FIG. 2, the index strip 52 includes a base 61 having a plurality of spaced teeth 62—62 projecting vertically from the base between grooved end walls 63—63 to form a plurality of conductor-receiving grooves 68—68. Each of the teeth 62—62 includes a nub 67 on one side surface thereof for securing the module 53 to the index strip 52. A platen surface 69 is formed lengthwise along the index strip 52 adjacent the risers 65—65 to serve as an anvil to facilitate the severance of ends of the conductors 56—56 which extend beyond the index strip. The index strip 52 also has a plurality of wells 71—71 which are formed between adjacent teeth 62—62 and risers 65—65 for receiving ends of the contact elements 58—58 of a connector module 53 mounted on the index strip.

The connector module 53 which is configured so as to be mounted or stacked on the index strip 52 includes a plurality of the contact elements 58—58. An upper portion of the connector module 53 terminates along a ledge 72 spaced below a platen 73 (see FIG. 2) which serves as a conductor-cutting anvil. A plurality of latching openings (not shown) open to a side wall of the connector module 53 to receive the latching nubs 67—67 of the index strip 52 to secure the connector module to the index strip. The connector module 53 also includes a plurality of teeth 78—78 and aligned risers 81—81 to form a plurality of conductor-receiving grooves 77—77 for holding the conductors 57—57.

The assembly of the connector 51 is completed with the cap 54, which is described in above-identified U.S. Pat. No. 3,858,158 and which is assembled to the connector module 53 to protect the upper bifurcated beams 83—83 and conductors 57—57 from moisture or other contaminants.

Figure 4:
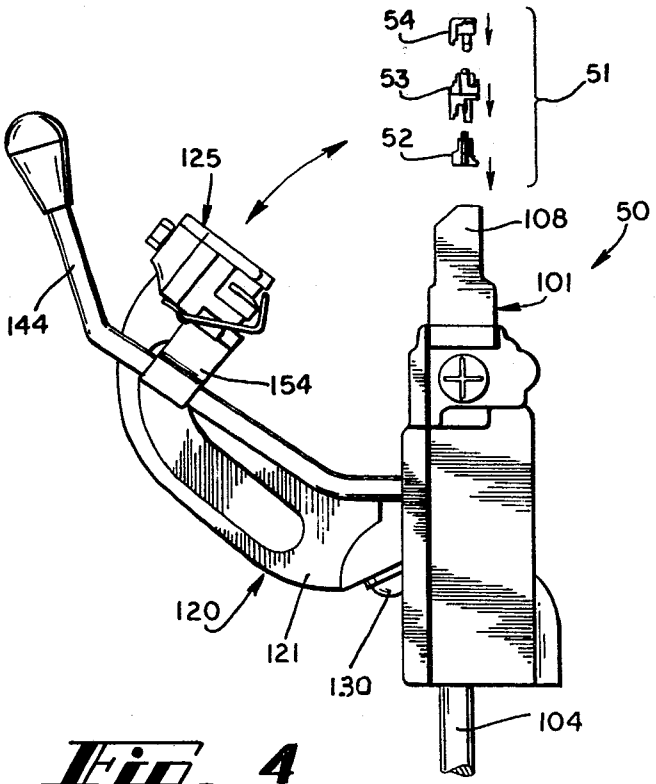
FIG. 4 is a side elevational view of the tool in FIG. 3 and showing the head in an unoperated position with all of the elements of the connector of FIG. 2 disposed above the tool for positioning on the support during successive steps of the assembly operation.
Figure 3:
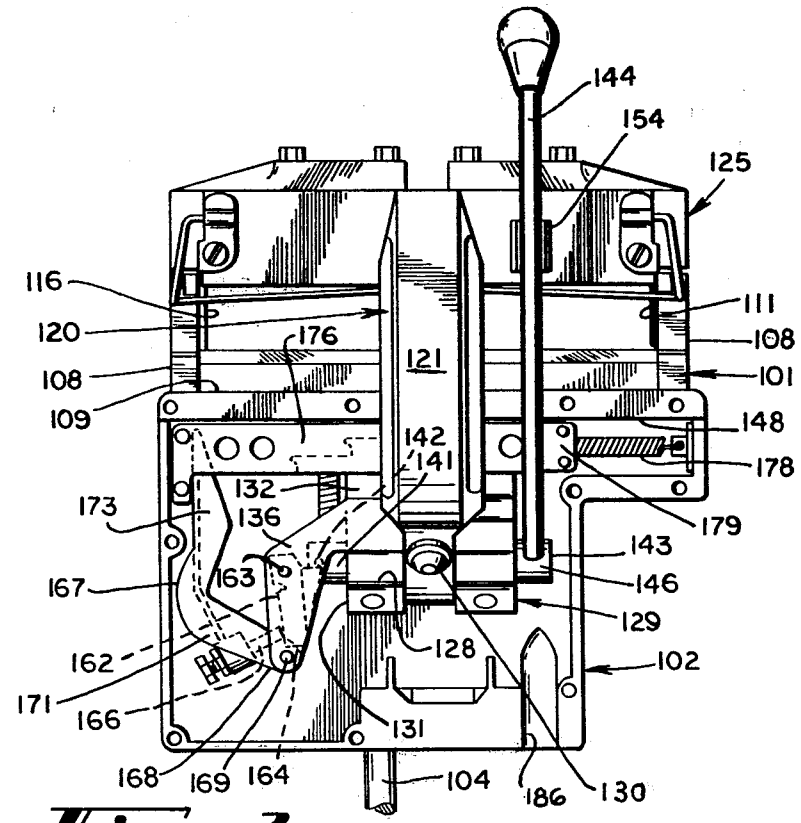
FIG. 3 is a front elevational view of the tool of FIG. 1 with a portion of a housing removed to disclose a mechanism which automatically compensates for the number of elements in the tool to hold a head of the tool at preselected distances with respect to a support for the elements.

In the use of the tool 50 to assemble elements of the connector 51 and conductors 56—56 and 57—57 which are to be spliced together, an installer positions an index strip 52 in a support which is referred to as a holding bracket assembly and which is designated generally by the numeral 101 (see FIGS. 1, 3 and 4). The holding bracket assembly 101 forms a top side of a housing 102 that is supported on a pedestal which includes a column 104 and a base 106. The housing 102 has a removeably mounted cover plate 107 for providing access to mechanical elements of the tool 50 which are located within the housing 102.

The installer also inserts one of the conductors 56—56 in each one of the conductor-receiving grooves 68—68 so that in the first sequence of steps of the operation of the tool 50, they are seated firmly in the grooves. It should be noted that the conductor-receiving grooves in the elements of the connector 51 are configured such that when an installer inserts conductors therein, the conductors are gripped by the walls of the grooves and held until they are seated during the operation of the tool 50.

The holding bracket assembly 101 includes oppositely disposed guides 108—108 that extend upwardly from each end of a support plate 109. A wire spring 111 protrudes from one guide 108 inwardly toward a centerline of the tool 50 while a rib 116 protrudes inwardly from the other guide to engage with the end grooves 63—63 which are molded into the index strip to hold it in the tool. The holding bracket assembly 101 also includes a slideably moveable keeper 112 that is urged outwardly from the plate 109 by a reciprocally moveable pin 113 until the index strip 52 is seated on the plate at which time the installer releases the pin 113 to permit the keeper to be urged inwardly until a lip 114 of the keeper engages the index strip to hold it from lateral sway during the assembly process.

The tool 50 also includes force-applying facilities such as a T-bar assembly, designated generally by the numeral 120, which during the positioning of the index strip 52 is disposed laterally of the housing as can best be seen in FIG. 4. The T-bar assembly 120 includes a head 125 which during each sequence of steps of the assembly is to be moved through a first incremental distance to engage a topmost connector element which is held in the holding bracket assembly 101 and then through a second incremental distance to seat and cut conductors or to assemble together connector elements in position on the plate 109. The tool 50 is self-compensating with respect to the combination of the first and second distances which vary because of the varying height of the connector elements on the plate 109.

Figure 5:
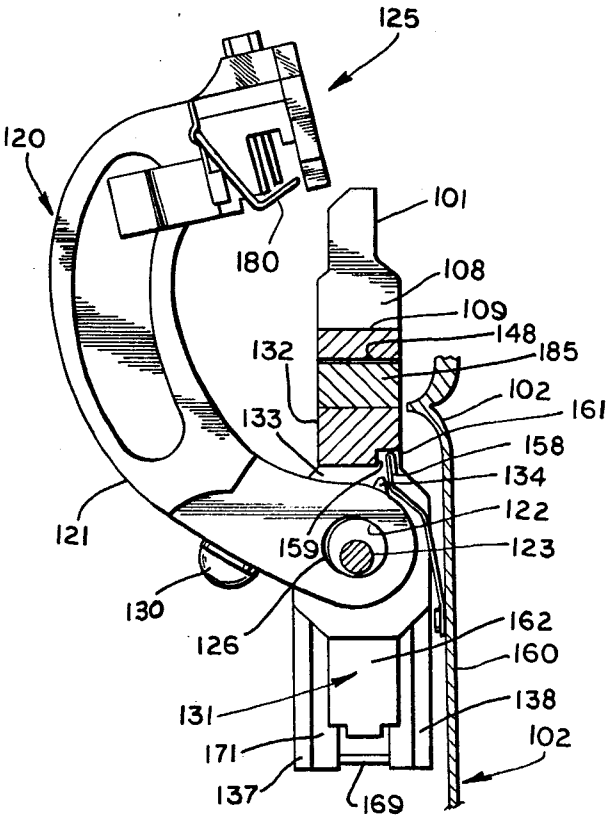
FIG. 5 is a view of the tool which is similar to the view shown in FIG. 4 but with a portion of the housing removed to show a device for preventing movement of the head in a vertical direction when the head is in other than an operative position.

The T-bar assembly 120 is also mounted for pivotal movement between the positions shown in FIGS. 3 and 4 so that the plate 109 is capable of being uncovered to receive conductor elements. This capability is provided by a connecting arm 121 which extends arcuately from the head 125 and which has an opening 122 therethrough for receiving a cam shaft 123 (see FIGS. 3 and 5) that is eccentrically mounted with respect to the opening 122. The pivotal movement of the T-bar assembly counterclockwise as viewed in FIG. 4 is limited by a button 130 which engages a lower portion of the housing 102. The cam shaft 123 has an enlarged center portion 124 with a lobe 126 and two end portions 127—127 which have a circular cross section. The end portions 127—127 are supported in bearings 128—128 of a cam shaft support assembly 129, which is designated generally by the numeral 129.

The cam shaft support assembly 129 includes a lower half 131 and an upper half 132 which at opposite ends thereof define the bearings 128—128 for receiving the end portions 127—127 of the cam shaft 123. Both the upper and lower halves 131 and 132 include a center opening for receiving a lower portion of the connecting arm 121 of the T-bar assembly 120. The upper half 132 includes a centrally disposed recess 133 (see FIGS. 5 and 6) for permitting passage of a plastic boss 134 which is attached to a lower portion of the connecting arm 121 when the connecting arm is rotated about the cam shaft 123. The upper half 132 also includes a downwardly depending U-shaped bracket 136, having side flanges 137 and 138, which cooperates with other portions of the tool 50 to provide for the selective height positioning of the T-bar assembly 120.

The cam shaft 123 has one end 139 (see FIG. 3) which extends beyond the halves 131 and 132 and between the flanges 137 and 138 of the bracket 136. A collar 141 is disposed about the left end of the cam shaft 123 (as viewed in FIG. 3) and has a relatively short pin 142 extending radially thereof. An operating lever 144 which is secured on the other end 143 of the cam shaft 143 through a collar 146 is designed to be turned pivotally from a topmost position as shown in FIG. 3 through an arc of about 160°. Moreover, the movement of the operating lever 144 through the arc causes a rotary motion of the cam shaft 123 to which the lever is connected.

In order to permit the head 125 to be moved through the first and second incremental distances to assemble the elements of the connector 51 and the conductors 56—56 and 57—57, the cam shaft support assembly 129 is mounted for reciprocal movement in a vertical direction on rods (not shown) that extend from an underside 148 of the plate 109. In an unoperated condition, the cam support assembly 129 is biased upwardly toward the holding bracket assembly 101 by a pair of vertically disposed tension springs 151—151 (see FIG. 10) which are attached to pins 152—152 on the top half 132.

Figure 6:
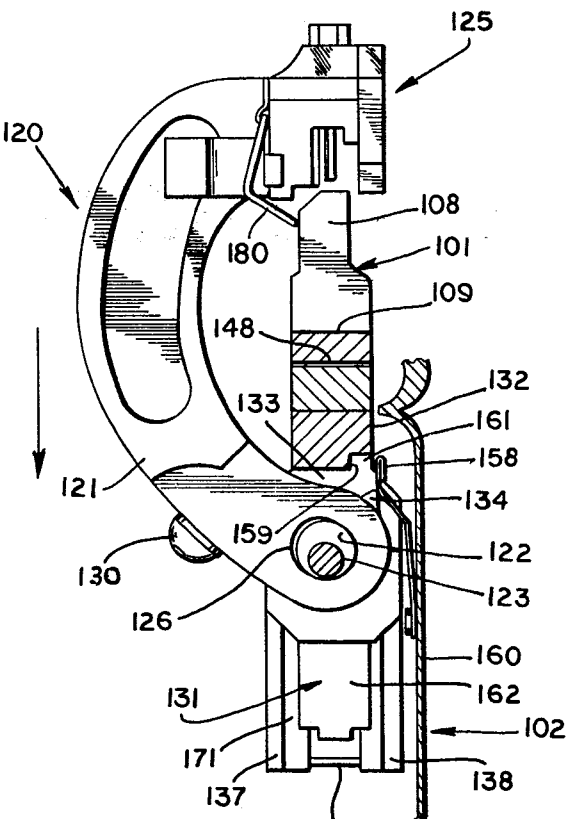
FIG. 6 is a view of the tool as shown in FIG. 5 but with the head in an operative position and with the device of FIG. 5 moved to permit downward movement of the head.

Although the cam support assembly 129 is moveable reciprocally within the housing 103, it should be held immoveable when the head 125 is not above the bed plate 109 to avoid malfunctioning of the tool 50. When the arm 121 is in such a position that the boss 134 is in a top center position (see FIG. 5), a leaf spring 158 which extends between a sidewall 160 of the housing and the cam support assembly 129 is biased inwardly toward a shoulder 159 of a notch 161 in the top half 132. This prevents the cam shaft support assembly 129 from being moved downwardly until the T-bar assembly 120 is turned pivotally to position the head 125 directly above the housing 102 as shown in FIG. 6. At that time, the boss 134 engages the leaf spring 158 and cams the spring out of engagement with the shoulder 159 and toward the wall 160 of the housing 102 whereupon the assembly 129 is freed for vertical movement through a second incremental distance which is arrested when the head 125 engages the topmost connector element on the support plate 109.

Because the operating lever 144 engages the head 125 as shown in FIGS. 1 and 3 and is removeably held by a clip 154 when it is in an upright position, the cam shaft 123 does not rotate relative to the T-bar assembly 120. Hence, both the operating lever 144 and the T-bar assembly 120 turn together when the installer moves the T-bar assembly to position the head 125 thereof above an index strip 52 which is held on the holding bracket assembly 101.

Figure 8:
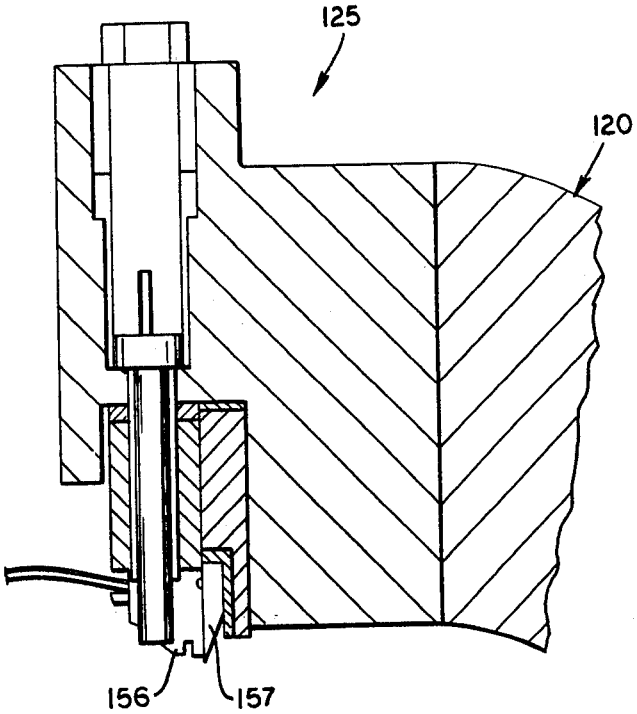
FIG. 8 is an enlarged sectional view of the head in FIG. 7 and showing a side view of a stuffer and a cutoff blade.
Figure 7:
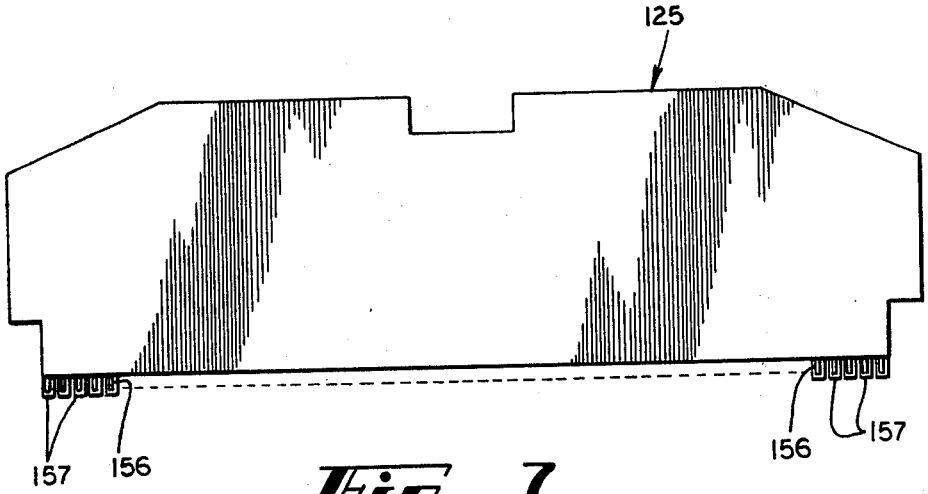
FIG. 7 is an enlarged front elevational view of the head and showing a plurality of assembly stuffers and a plurality of blades for severing excess lengths of the conductors which are assembled to elements of the connector.

The head 153 includes a plurality of stuffers 156—156 (see FIGS. 7 and 8) which are spaced apart longitudinally along the underside of the head. The spacing between that of the stuffers 156—156 is the same as that between the conductor receiving grooves 68—68 in the index strip and the conductor-receiving grooves 77—77 in the connector module 53. The stuffers 156—156 are effective to apply forces to the conductors 56—56 along their longitudinal axes to seat the conductors within the conductor-receiving grooves 68—68 in the index strip 52. These stuffers 156—156 are also used to apply forces to the connector module 53 and to the cap 54 to assemble those elements to the index strip 52.

The head 125 also includes a plurality of individual knife blades 157—157 spaced apart slightly and disposed linearly along an edge of the head. During a second or slow incremental movement of the head 125 when only the index strip 57 is supported in the bracket assembly 101, the blades 157—157 engage and sever excess lengths of the conductors 56—56 which extend beyond the index strip 52 with the ledge 72 of the index strip 52 serving as a cutting anvil. The individual blades 157—157 are also effective to establish electrical engagement individually with the conductors 56—56 or 57—57 so that electrical tests may be conducted during the assembly operation.

With the operating lever 144 in an up position as shown in FIGS. 1 and 3, the pin 142 is directed normally of the flange 137 of the downwardly depending bracket 156. The pin 142 in that position also overlies a top surface 165 of a primary lever 162 which is mounted rotatably on a rod 163 extending between the two side flanges 137 and 138 of the downwardly depending U-shaped bracket 136. The primary lever 162 has a plate portion 164 which is engaged by an adjustable stud 166 extending from a return finger 167 that has a lower portion 168 mounted rotatably on a small diameter shaft 169 that extends between the lower ends of the flanges 138 and 137 of the downwardly depending bracket 136. The return finger 167 has a portion 171 from which the stud 166 extends and has an upper end 173 which extends into operative engagement with one end of a slide spacer 176.

The slide spacer 176, which is rendered effective between movements of the head 125 through the first and second incremental distances, is mounted for reciprocal movement in a guideway formed in the side wall 160 in the housing 102 and is biased toward the right as viewed in FIG. 3 by a spring 178. The slide spacer 176 has a U-shaped cross-section so that side legs 179 thereof encompass the sides of the upper half 132 of the cam shaft support assembly 129 and receive the upper end 173 of the return finger 167. Moreover, the side legs 179—179 of the slide spacer 176 is formed with at least two steps along its length. It should be apparent from the drawings that when the pin 142 extending from the hub 141 is in engagement with the top surface of the primary lever 162, the lever 144 is in an upright position as shown in FIG. 3 and the slide spacer 176 is inoperative.

Figure 9:
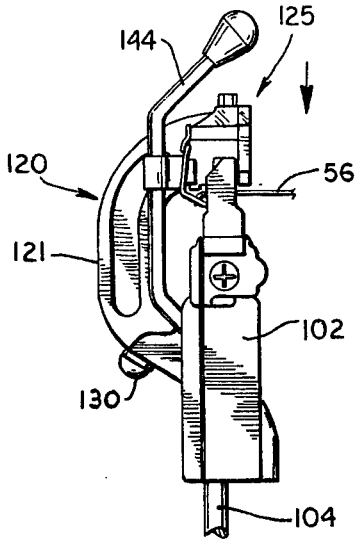
FIG. 9 is a side elevational view of the tool and showing the positioning of a plurality of conductors from a first group of conductors in an index strip which is supported in the tool.

In the next step of the assembly, the installer moves the head 125 downwardly (see FIG. 9) through a first incremental distance until it engages the index strip 52. This causes the cam shaft support assembly 129 which is connected to the T-bar assembly 120 through the cam shaft 123 and the lower portion of the connecting arm 121 to overcome the tensile forces exerted by the springs 151—151 and be moved downwardly a corresponding first incremental distance. At this time, the cam shaft support assembly 129 is spaced above a pair of arresting posts 181—181 which are effective to prevent excessive downward movement of the cam shaft support assembly 129 when there are no connector elements supported in the assembly 101. It should also be observed from FIG. 9 that a safety guard 180 is pivoted slightly in a counterclockwise direction with the conductors 56—56 extending through the index strip 52.

Figure 10:
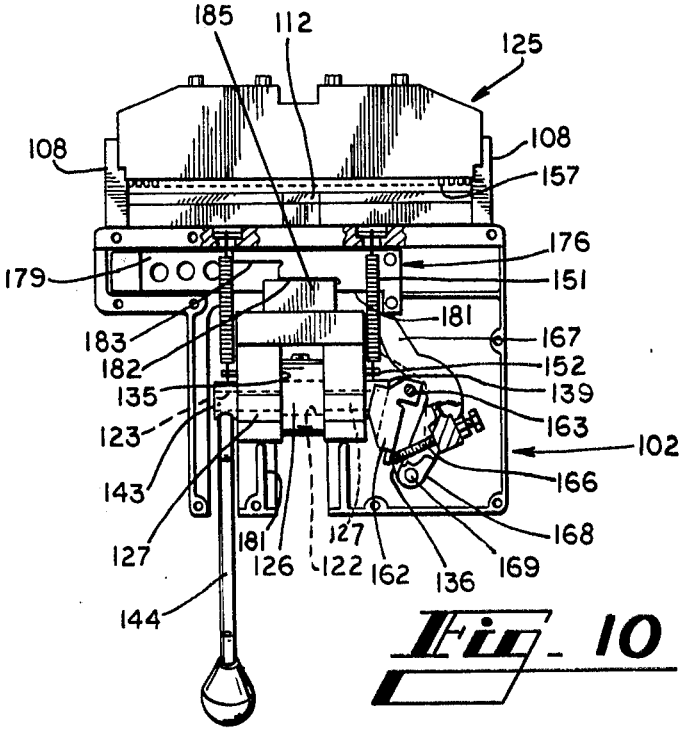
FIG. 10 is a rear elevational view of the tool with a portion of the housing removed to show the selective height positioning mechanism during the downward movement of an operating lever to hold the head spaced a predetermined distance from the index strip.

Once the operating lever 144 is swung downwardly to start a cycle of operation and through a small portion of its arc toward a lower position, the pin 142 is rotated upwardly to release the primary lever for pivotable movement about the shaft 163 which permits the slide spacer 176 to be moved to the left as viewed in FIG. 10 under the influence of the spring 178. This movement of the slide spacer 176 turns the return finger 167 clockwise as viewed in FIG. 3 (or counterclockwise as viewed in FIG. 10) about the lower shaft 169 thereby causing the stud 166 to move to the right (or left as viewed in FIG. 10). The movement of the stud 166, which is in engagement with the plate 164 moves pivotally the primary lever 162 in a counterclockwise direction (as viewed in FIG. 3), which pivotal movement of the primary lever was prevented by the pin 142 prior to the operation of the lever 144.

The extent to which the slide spacer 176 moves is determined by the step of the assembly operation to be performed and the step is determined by that element or elements of the connector 51 which is or are present in the support plate 109 of the tool 50. The lowering of the head 125 to engage the index strip 52 spaces a die set portion 185 of the cam shaft support assembly 129 a distance from the underside of the holding bracket assembly 101 which permits a greater height step 182 of the slide spacer to be moved therebetween (see FIG. 10).

Figure 11:
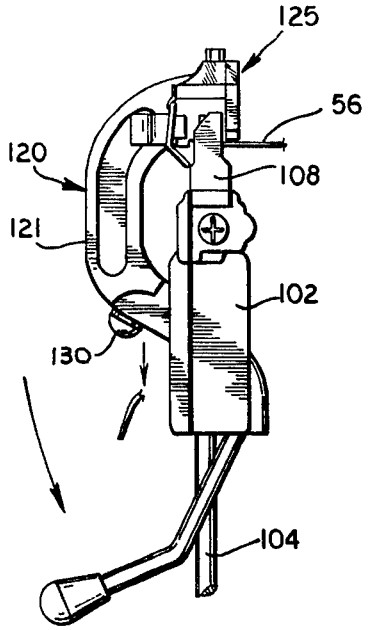
FIG. 11 is a view of the tool subsequent to that shown in FIG. 9 in a fully operated position and showing the conductors seated in the index strip and excess lengths severed.

Further pivotal movement of the operating lever 144 (see FIG. 11) causes the lobe 126 of the cam shaft 123 to be moved relative to the T-bar assembly 120. This causes forces to be imparted to the lower portion of the connecting arm 121 to move the T-bar assembly 120 and head 125 downwardly relative to the cam shaft support assembly 129 through a second incremental distance to seat the conductors 56—56 in the index strip 52. The assembly 129, the slide spacer 176 and the support bed plate 109 are in tight stationary engagement with one another during this movement of the head 125 so that as the lever 144 reaches a bottommost position, the bed resists the assembly forces imparted to the index strip 52 so that the conductors are seated in the conductor-receiving grooves and severed to length. The pivotal movement of the operating lever 144 is limited by a notched portion 186 of the housing.

During the operation of the lever 144 from an unoperated generally vertical position in FIG. 6, the cam lobe 126 on the cam shaft 123 is moved from a position about 30° counterclockwise of a vertical axis as viewed in FIG. 6 to a position slightly counterclockwise of a bottommost position of the shaft. This locks the lever 144 in its fully operated position so that the installer, if desired, can then perform electrical tests while the blades 157—157 are yet in engagement with the exposed conductive portions of the severed conductors.

Following the seating and cutting of the conductors 56—56 in the index strip 52, the installer turns the operating lever 144 upwardly to move the cam shaft 123 and the lobe 126 to unlock the T-bar assembly 120. This also rotates the shaft 123 to engage its pin 142 with the primary lever plate 162 thereby causing the plate to rotate clockwise, as viewed in FIG. 3, and to engage the stud 166. This moves the stud 166 to the left as viewed in FIG. 3 and causes the return finger 167 to move the slide spacer 176 leftwardly (or rightwardly as viewed in FIG. 10). Then the head 125 is opened, i.e. turned rotatably from a position above the index strip 52 to a position shown in FIG. 4, whereupon the boss 134 on the lower portion of the arm 121 disengages the leaf spring 158 to permit the leaf spring to engage the shoulder 159 in the underside of the top half 132 of assembly 129 (see FIG. 5) to prevent the assembly from being moved downwardly.

Figure 12:
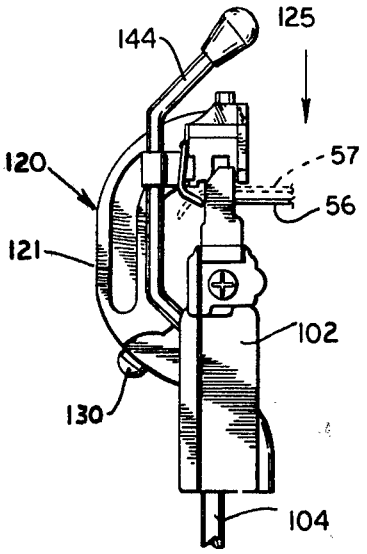
FIG. 12 is a view showing the use of the tool to assemble a connector module to an index strip having conductors of the first group assembled thereto and also showing the use of the tool to assemble a plurality of conductors from a second group into the conductor module after it has been secured to the index strip.

Then the installer positions a connector module 53 on the index strip 52 and rotates the head 125 to an up position as shown in FIG. 12, which releases the leaf spring 158 from engagement with the cam support assembly 129 (see FIG. 6). The head 125 is pushed downwardly by the installer to engage top portions of the connector module 53 and to engage the stuffers 156—156 with the bottom portions of the conductor-receiving grooves 77—77. It should be observed that at this time, the conductors 57—57 are not positioned in the conductor-receiving grooves 77—77 of the module, but will be seated therein in another sequence of steps after the module 53 has been secured to the index strip 52. This downward movement of the head 125 spaces the cam shaft support assembly 129 from the underside of the plate 109, but because of the increased height of connector elements due to the presence of the connector module 53, the spacing is only great enough to permit entry of a lesser height step 183 (see FIG. 13) in the side walls of the slide spacer 176. In this way, the head 125 is positioned so that the forces applied by it as it is moved through the second incremental distance when the lever 144 is operated (see FIG. 14) are sufficiently great to assemble the connector module 53 to the index strip 52, but are not so great as to damage the connector module.

It should be appreciated that the head 125 is selectively positioned relative to the stage of assembly of the connector 51 which is supported on the plate 109 at any one time. The positioning of the head 125 and the movement of which it is capable because of the insertion of the slide spacer 176 insures that the forces applied to elements of the connector are sufficient and not excessive for each particular stage of the assembly. The movement of the operating lever handle 144 through an arc causes the positioning of the slide spacer 176 between movements through the first and second incremental distances as well as the assembly and/or cutoff of conductors during the movement through the second incremental distance.

Figure 14:
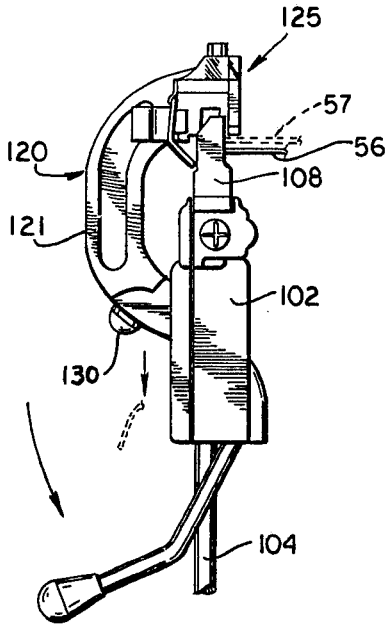
FIG. 14 is a view of the tool subsequent to that shown in FIG. 12 with the connector module assembled to the index strip.
Figure 13:
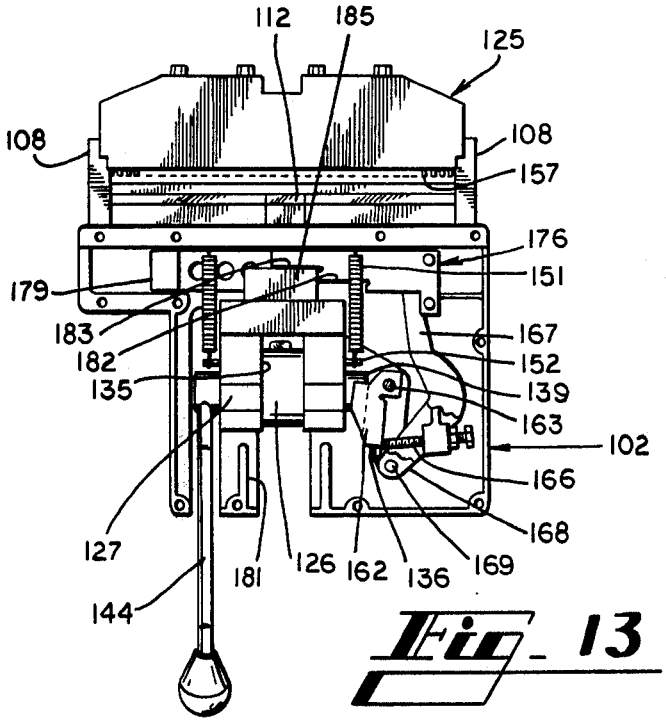
FIG. 13 is a rear elevational view of the tool of FIG. 1 with a portion of the housing removed to show the selective height positioning mechanism with the index strip and the connector module supported in the tool.

Another sequence of steps is used to assemble the conductors 57—57 to the connector module 53 by moving them into the conductor-receiving slots 82—82 of the upper bifurcated beams 83—83 of the contact elements 58—58 in the connector module. The installer positions a conductor 57 in each conductor-receiving groove 77 of the connector module 53 which is aligned with the conductor-receiving slot 82 of a contact element 58 in the connector module. FIGS. 12-14 of the drawings depict the steps of seating the conductors as well as the securing of the module 53 to the index strip 52. It should be appreciated that in a preferred embodiment, the conductors 57—57 shown in phantom in FIGS. 12-14 are intended to show that during the securing step, the conductors are not present. However, it is possible to assemble the conductors 57—57 to the connector module in the same sequence of steps in which the connector module is securred to the index strip 52.

The slide spacer 176 is reoperated by installer-initiated movement of the operating lever 144 to reinsert the lesser height step 183 thereof between the cam shaft support assembly 129 and the holding bracket assembly 101. When the operating lever assembly 144 reaches its lowermost position, the selective height positioning of the head 125 causes the stuffers 156—156 to apply sufficient forces to the conductors to move them into the conductor-receiving slots 82—82 of the contact elements 58—58. Simultaneous with the seating of the conductors 57—57, the individual blades 157—157 sever excess lengths of the conductors in engagement with the ledge 79 of the connector module 53.

Figure 15:
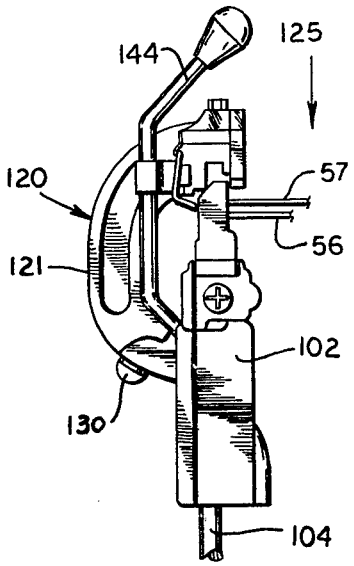
FIGS. 15–17 are a sequence of views which show the tool during the assembly of a cap to the connector module similar to the sequence shown in FIGS. 12–14 and with FIG. 16 showing the selective positioning mechanism with the cap placed over the connector module and prior to the securing of the cap to the connector module.
Figure 17:
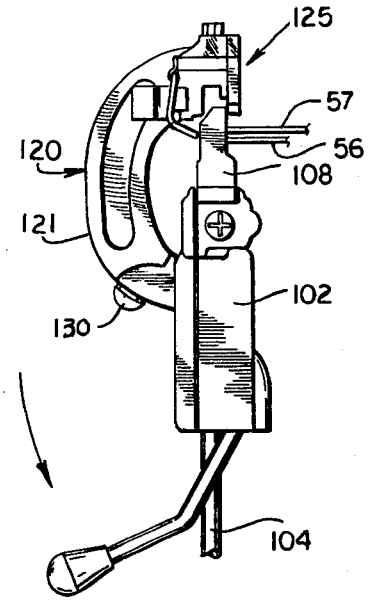
Figure 16:
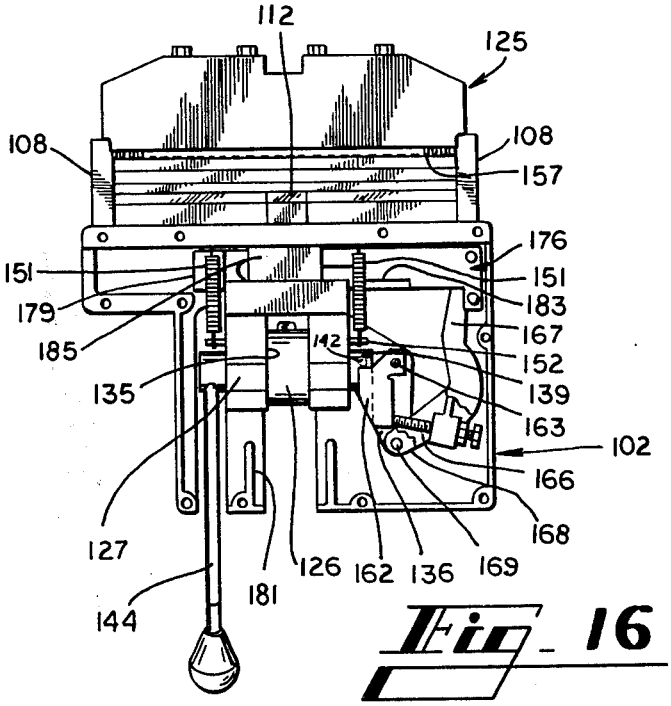

A similar sequence of steps is used to assemble the cap 54 to the connector module 53 to cover the conductors 57—57 and top beams 83—83 of the contact elements 58—58 (see FIGS. 15-17). In that sequence, however, the increased height of stacked connector elements on the plate 109 is such that the downward movement of the head 125 into engagement with the cap produces no spacing between the plate 109 and the cam support assembly 129 (see FIG. 16). The slide spacer 176 cannot move notwithstanding release thereof by a movement of the pin 142 and further movement of the lever 144 imparts sufficient forces to the cap to lock it in engagement with the connector module 53.

In an alternate embodiment 200 of the tool 50, the selective positioning of portions of the tool is accomplished by a double cam arrangement instead of by the slide spacer 176. As can best be seen in FIG. 18, the tool 200 includes a head, designated generally by the numeral 201, which is identical to the head 125, a holding bracket assembly 202 which is identical to the assembly 101 and a T-bar assembly designated generally by the numeral 203.

Figure 19:
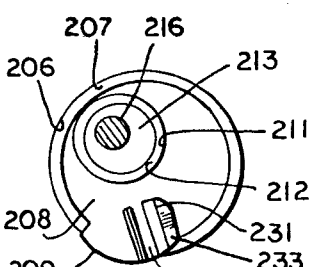
FIG. 19 is an enlarged view of a portion of the tool of FIG. 18 and showing a double cam arrangement for selectively positioning a head relative to a connector support.

The T-bar assembly 203 has an enlarged lower hub 204 having an opening 206 therein for holding an annular cam race 207 having a stop 205. A fast travel cam 208 (see FIG. 19) having a lobe 209 adjacent a step 210 is positioned in the cam race 207 and has an opening 211 for receiving a cam race 212 and a slow travel cam 213 having a lobe 214. A shaft 216 extends through an opening 217 in the slow travel cam, and is supported in bearings 218—218 held in hangar portions 221—221 which depend from an underside of the holding bracket assembly 202.

One end of the shaft 216 extends through the depending portions 221 and 222 and has an operating lever assembly 224 attached thereto. The operating lever assembly 224 functions in a manner similar to that of the operating lever assembly 144 and is used by an installer to cause the head 201 to be moved through first and second incremental distances.

The other end 226 of the shaft 216 has a detent arm 227 attached thereto and extending radially toward the lobe 209 of the fast travel cam 208 where a spring-biased detent 228 on the arm is received in a groove 229 of a pedestal 231 that is attached to an extension 232 of the cam 208 adjacent its lobe 209. A stop 233 is attached to a side of the pedestal 231 and extends radially for a portion of the cam 208. The stop 233 is adapted to engage a recess 234 in an abutment 236 that is attached to a hub 237 of the T-bar assembly 203. It should be noted that after a predetermined force has been applied to the detent arm 227, the bias of the spring 238 will be overcome to cause the detent 228 to be moved out of the groove 229.

Figure 20:
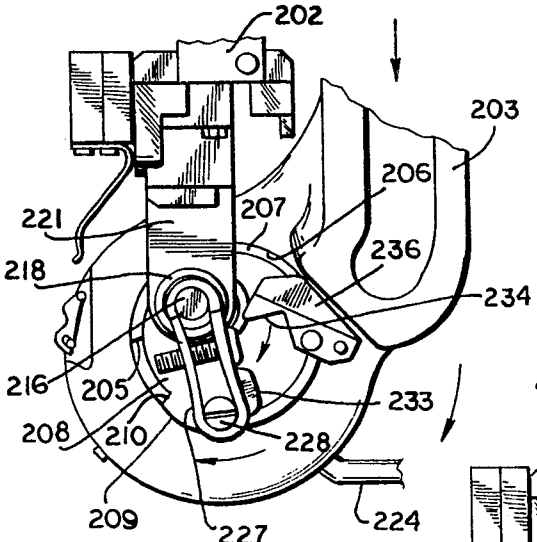
FIGS. 20–21 are a sequence of views which show the movement of the cams during the assembly of conductors of a first group to the index strip.

In the use of the tool 200 to assemble the connector 51 and conductors 56—56 and 57—57, an installer moves the T-bar assembly 203 and operating lever 224 to an "open" position to permit an index strip 52 and conductors 56—56 to be positioned on the holding bracket assembly 201. Then the installer rotates the T-bar assembly 203 in a counterclockwise direction, as viewed in FIG. 18, to position the head 201 above and aligned with the index strip 52. Next, the operating lever 224 is rotated in a clockwise direction (see FIG. 20) to turn the shaft 216. This causes the detent arm 227 to move the fast travel cam 208 within the race 207 thereby causing the T-bar assembly 203 to be moved downwardly through a first incremental distance to seat the head 201 firmly in engagement with the index strip 52 and the conductors 56—56 which have been placed thereacross. The travel of the fast cam 208 is about 90° and causes the head to be moved about 1.92 cm. It should be observed that during the movement of the head 201 through the first incremental distance, the cam 213 moves together with the cam 208.

Figure 21:
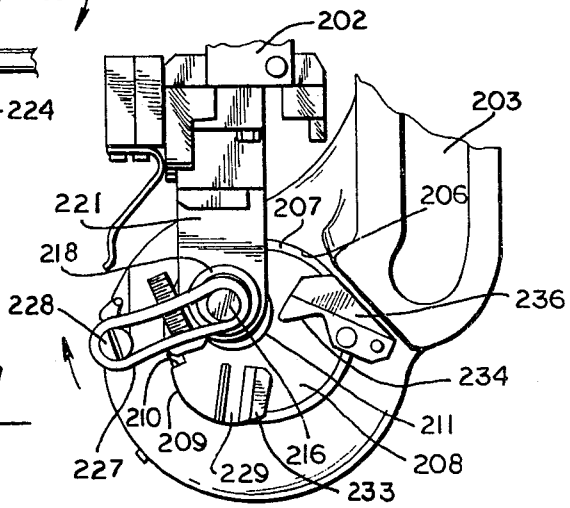

Further rotary movement of the operating lever 224 and the detent arm 227 causes the pedestal 231 to exert sufficient forces against the detent 228 to cause the forces of the spring 238 to be overcome and the detent moved normally of the cam surface out of the groove 229 (see FIG. 21). The detent 229 moves with the arm 227 without further moving the large fast travel cam 208 which is about at a dead center position with a center of its lobe about 1° past a vertical line. When the fast travel cam 208 is in this position, it is locked against a return movement counterclockwise toward the abutment 236. It is also locked against further movement in a clockwise direction by the engagement of the step 210 with the cam race stop 205.

The design of the inner or slow travel cam 213 is such that with the fast travel cam 208 having its lobe 209 at a bottom dead center position, it can still travel before locking in against its race 212. Hence, further movement of the detent arm 227 causes the inner cam 213 to be turned slightly independently of the cam 208 and through an angle of about 40° which causes about a 0.13 cm movement of the head 201. This causes the conductors 56—56 to be severed against the ledge 66 and seats the conductors firmly within the conductor-receiving grooves 68—68 of the index strip 52.

Then the installer turns rotatably the operating lever 224 to engage the detent 228 with the pedestal 231 to move the pedestal and the cam 208 until the stop 233 engages the recess 234 in the abutment 236. At that time the operating lever 224 is in the position shown in FIG. 18 clipped to the T-bar assembly 203 ready for a next step in the assembly.

Figure 22:
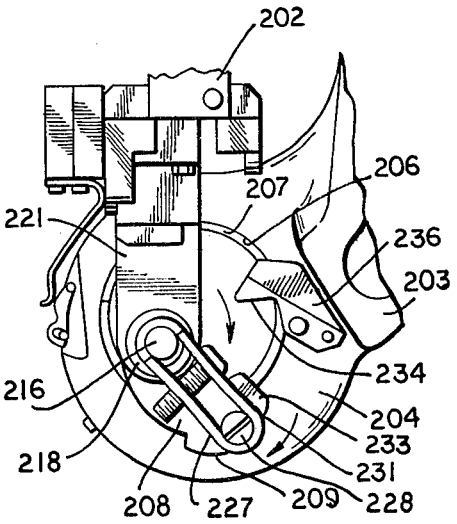
FIGS. 22–23 are a sequence of views which show the movement of the cams during the assembly of the connector module to the index strip and during the assembly of a second group of conductors to the connector module.

The T-bar assembly 203 is turned to expose the index strip 52 and the installer positions a connector module 53 above it in the holding bracket assembly 202. The T-bar assembly 203 is returned to its ready position above the connector module 53 and the operating lever 224 is moved through an arc with an initial movement causing the shaft 216 to drive the detent arm 227 to turn the cam 208. With the increased height of connector elements now in the holding bracket assembly 202, the movement of the detent arm 227 is through an arc of about 50° before the detent 228 is caused to leave the groove 229 (see FIG. 22) to free the shaft 216 for further movement. The forces on the cams 208 and 213 are such that until the fast travel cam 208 overrides a lowermost position and is locked in its race, the cam 208 tends to return to an initial position in engagement with the abutment 236. Hence, as the detent 228 is caused to move out of the groove 229, the cam 208 returns to an initial position with the stop 234 in engagement with the abutment 236.

Figure 23:
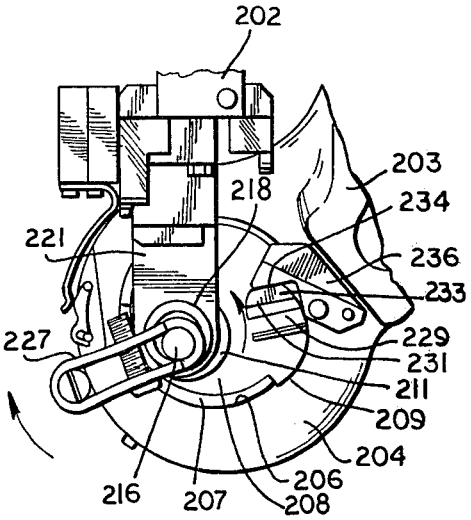

Further movement of the operating lever 224 and shaft 216 turns the inner, slow travel cam 213 independently of the cam 208 and the detent arm 227 to about the same position as in the prior cutting and seating step (see FIG. 23). This permits the head 201 to be moved through the second incremental distance which is sufficient to seat the connector module 53 in secured engagement with the index strip.

Figure 18:
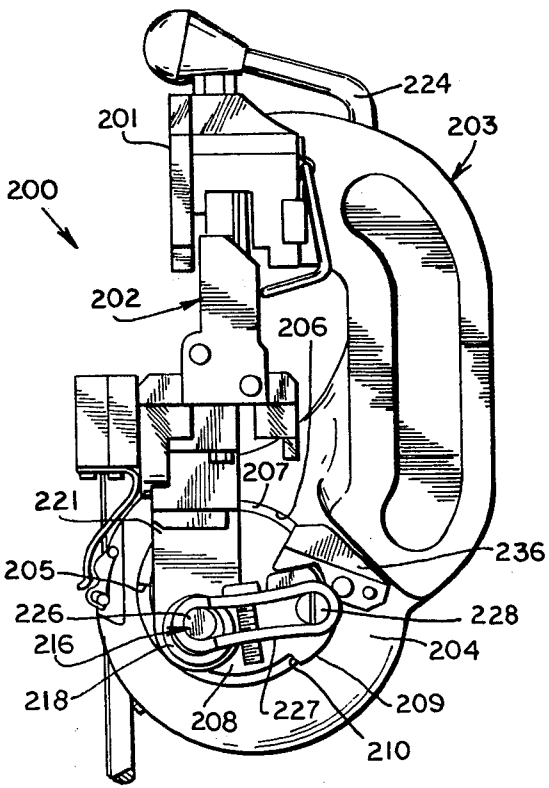
FIG. 18 is a side elevational view of an alternative embodiment of the tool.

The installer moves the operating lever 224 counterclockwise as viewed in FIG. 18 to an initial position in engagement with the head 201. The turning of the lever 224 causes the inner cam 213 to be moved in a counterclockwise direction to cause the detent arm 227 to be moved to urge the detent 228 into the groove 229 of the pedestal 231 which is in engagement with the abutment 236. The installer turns the T-bar assembly clockwise to uncover the connector module 53 and positions a conductor 57 in each of the conductor-receiving grooves 77—77 along the top of the module.

In a next sequence of steps, the installer closes the head 201 by moving the T-bar assembly counterclockwise as viewed in FIG. 18 to position the head 202 above the connector module which is now loaded with the conductors 57—57. The lever 224 is turned to turn the shaft 216 and the cams 208 and 213 together to move the head through the first incremental distance (see FIG. 22). Then as described hereinbefore during the securing of the connector module 53 in engagement with the index strip 52, the further turning of the lever 224 causes the detent arm to be returned to engagement with the abutment 236 (see FIG. 23) and the second cam 213 to be moved independently to move the head through the second incremental distance to seat the conductors 57—57 and to sever their excess lengths.

Figure 24:
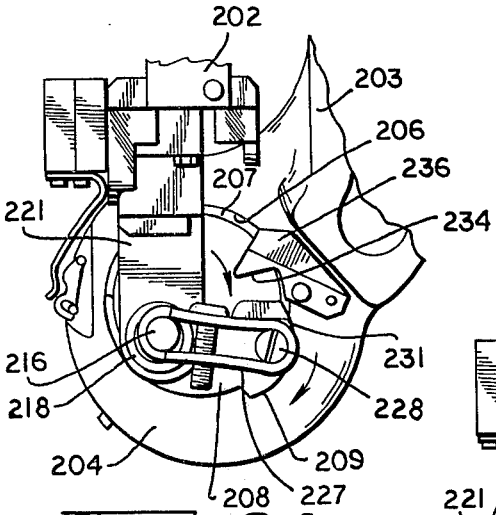
FIGS. 24–25 are a sequence of views which show the positions of the cams during the assembly of the cap to the connector module.
Figure 25:
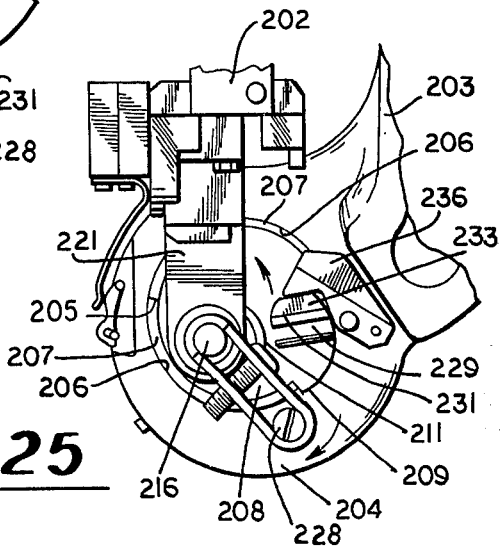

The cap 54 is assembled to the connector module 53 with the tool 200 in a sequence of steps which are depicted in FIGS. 24 and 25. After the cap 54 has been positioned above and in unsecured engagement with the connector module 53, the installer turns the operating lever 224 to turn the first travel cam 208 and the slow travel cam 213 together through a relatively small arc corresponding to the movement of the head through a first incremental distance to engage the cap 54 and the connector module in tight but still unsecured engagement with each other. Further turning of the operating lever 224 causes the detent 228 to be moved out of the groove 229 which, as before, permits the detent arm to return to engagement with the abutment 236. The locking of the cap 54 to the connector module 53 is accomplished as the lever 224 is turned further to turn to cam 213 independently of the cam 208 and to move the head 201 through the second incremental distance.

It is to be understood that the above-described arrangements are simply illustrative of the invention. Other arrangements may be devised by those skilled in the art which will embody the principles of the invention and fall within the spirit and scope thereof.

What is claimed is:

1. A tool for assembling stackable elements to form a connector and for assembling conductors to the elements, which comprises:

means for supporting the connector during its assembly in which adjacently positioned elements are secured together to form a stack of elements and conductors are assembled to elements;

means for applying forces to each successively stacked element positioned in the supporting means to secure it to an adjacent element previously positioned in the supporting means and for applying forces to conductors to assemble the conductors to the elements;

means for mounting said force-applying means for reciprocal movement which includes movement in one direction through first and then second incremental distances;

means for moving the means for applying forces through the first incremental distance to engage each successively stacked element and to engage conductors positioned in an element which is held in the supporting means and for then moving said force-applying means through the second incremental distance to secure adjacent elements together and to secure conductors to an element; and means responsive to the movement of the means for applying forces through the first incremental distance and to the initiation of the movement through the second incremental distance for spacing said force-applying means a predetermined distance from the supporting means, said spacing means capable of compensating for the number of elements which are held in the supporting means to cause the movement of said force-applying means through the second incremental distance to be effective to secure together adjacent elements and to secure conductors to an element.

2. A tool for assembling elements of a connector, which includes an index strip and a connector module, and for assembling conductors to the elements, which comprises:

means for supporting the connector during a sequence of steps of its assembly in which a first group of conductors is assembled to the index strip, a connector module is assembled to the index strip and connected to the first group of conductors, and a second group of conductors is connected to the connector module;

means, which includes a head, for applying forces to the connector module to assemble the connector module to the index strip and for assembling the one group of conductors to the index strip and the second group of conductors to the connector module;

means for mounting the force-applying means to facilitate movement of the head in a first direction through first and second incremental distances toward the supporting means and in an opposite direction away from the supporting means;

means operable in each of the sequence of assembly steps for moving the force-applying means through the first incremental distance to engage the first group of conductors which is positioned in the index strip, to engage a connector module which is positioned above and in engagement with the index strip, and to engage the second group of conductors which is positioned in the connector module and then for moving the head through the second incremental distance toward the supporting means to secure the first group of conductors to the index strip, to secure the connector module to the index strip, and to secure the second group to the connector module, and then in an opposite direction away from the supporting means; and means responsive to the movement of the head through the first incremental and to the initiation of movement through the second incremental distances for spacing the force-applying means a predetermined distance from the supporting means to cause the movement of the head through the second incremental distance to be effective to assemble elements of the connector and conductors to the elements.

3. The tool of claim 2, wherein the first incremental distance varies as a function of which elements are held on the supporting means and the second incremental distance is substantially constant.

4. The tool of claim 2, wherein the means for applying forces includes an upper portion mounted for movement above the supporting means and a lower portion connected to the upper portion and mounted for corresponding movement below the supporting means, wherein the means for spacing the force-applying means a predetermined distance includes a slideably moveable member having a stepped configuration, and means for biasing the slideably moveable member to a position interposed between the lower portion of the force-applying means and the supporting means, the means for moving the force-applying means when in an unoperated position being effective to prevent the slideably moveable member from being moved by the biasing means, and the movement of the force-applying means through the first incremental distance and the initiation of its movement through the second incremental distance being effective to space the lower portion of the force-applying means from the supporting means to permit the slideably moveable member to be moved between it and the supporting means to space the head the predetermined distance from the supporting means so that the movement through the second incremental distance is sufficient to assemble elements and conductors to elements without causing damage to the elements and conductors.

5. The tool of claim 4, wherein the lower portion of the means for applying forces includes an arm having an opening in a lower end thereof and having its upper end connected to the head, a shaft which extends through the opening in the lower end of the arm, and an assembly which depends from and is slideably moveable with respect to the supporting means for supporting rotatably the shaft, the arm being mounted for pivotal movement on the shaft, and wherein the moving means includes a lever which is attached to the shaft to turn the shaft, the lever being in an unoperated position when the force-applying means is moved through the first incremental distance, said movement of the force-applying means through the first incremental distance causing the head to engage the element of the connector on the supporting means and the lower portion to be spaced below the supporting means, the slideably moveable member responding to the movement through the first incremental distance and the initiation of movement through the second incremental distance, by a partial movement of the lever, to be interposed between the supporting means and the lower portion to lock the shaft support assembly in engagement with the supporting means and to space the head the predetermined distance from the supporting means, the movement of the lever pivotally to a fully operated position causing the force-applying means to be moved through the second incremental distance.

6. The tool of claim 5, wherein the force-applying means also includes means connected to the shaft and which is effective when the lever is in an unoperated position for holding the slideably moveable member to one side of the lower portion of the force-applying means, and which is effective when the lever is moved pivotally through a partial arc from its unoperated position for releasing the slideably moveable member whereupon the biasing means urges the slideably moveable member to move between the supporting means and the lower portion of the force-applying means.

7. The tool of claim 6, wherein the assembly for supporting the shaft includes a central recess for receiving the lower end of the arm, the portion of the shaft which extends through the lower end of the arm and disposed in the recess including a camming portion so that after the head is moved through the first incremental distance and the slideably moveable member is interposed between the lower portion of the force-applying means and the supporting means, the movement of the lever turns the camming portion to cam the lower end of the arm downwardly to cause the head to be moved through the second incremental distance.

8. The tool of claim 7, wherein movement of the lever to the fully operated position causes the camming portion of the shaft to lock the force-applying means in a fully operated position.

9. The tool of claim 7, wherein movement of the lever from the fully operated position toward the unoperated position rotates the cam shaft to unlock the shaft support assembly, the slideably moveable member and the supporting means, and the holding means which is attached to the shaft is effective to remove the slideably moveable member from a position between the supporting means and the shaft support assembly.

10. The tool of claim 6, wherein the assembly for supporting the shaft includes a recess for receiving a leaf spring which extends from the supporting means to prevent downward movement of the lower portion of the head when the head is not above the supporting means and further includes a boss mounted on the lower end of the arm connecting the upper and lower portions of the force-applying means which is effective when the arm is moved pivotally to position the head above the supporting means at the start of a cycle of operation to overcome the leaf spring and move it out of the recess whereupon the head is capable of being moved through the first incremental distance into engagement with an element held on the supporting means.

11. The tool of claim 2, wherein the force-applying means includes an upper portion for engaging the elements of the connector and the conductors, and a lower portion which is connected to the upper portion and which includes an opening, and wherein the tool also includes:

a fast travel cam disposed within the opening in the lower portion and having an opening therein;

a slow travel cam disposed within the opening in the fast travel cam, the slow travel cam having an opening therein;

a shaft which extends through the opening in the slow travel cam; and an operating lever attached to the shaft and which when operated causes the fast travel cam to turn to cause the lower portion and the connected upper portion of the head to be moved downwardly through the first incremental distance and the further movement of the lever causes movement of the slow travel cam independently of the fast travel cam to move the head downwardly through the second incremental distance.

12. The tool of claim 11, which also includes:

an abutment attached to the lower portion of the force-applying means;

an arm connected to the shaft and extending radially of the shaft with a free end adjacent to the periphery of the fast travel cam and adjacent a lobe thereof;

a spring-biased detent extending normally of the arm at its free end thereof toward the fast travel cam; and a nest attached to the fast travel cam for receiving the detent, wherein the partial movement of the lever turns the cam shaft and the detent arm to cause the detent seated in the nest to cause the fast travel cam to turn until the lobe on the fast travel cam locks the fast travel cam in its opening against further turning, the continued movement of the lever causing the detent to be moved out of its nest whereupon the slow travel cam continues to rotate with the cam shaft until the head is moved through the second incremental distance.

13. The tool of claim 12, wherein the fast travel cam is contoured so that when the connector module is positioned above the index strip and the lever is operated, the fast travel cam is turned through an arc which is less than the arc through which it turns when the index strip is the only element held in the supporting means and the movement of the detent out of the nest on the fast travel cam and continued movement of the cam shaft allows the fast travel cam to turn in an opposite direction until its nest engages the abutment to hold the lower portion of the force-applying means spaced from the supporting means so that the further turning of the lever and movement of the head through the second distance is effective to secure the connector module to the index strip and to assemble conductors to the connector module without damaging the elements or conductors.

* * * * *